US008166781B2

(12) United States Patent
Lee et al.

(10) Patent No.: US 8,166,781 B2
(45) Date of Patent: May 1, 2012

(54) DETERGENT SUPPLY APPARATUS AND WASHING MACHINE

(75) Inventors: Jong Min Lee, Seoul (KR); Young Ho Kim, Seoul (KR); Jae Hyun Kim, Seoul (KR); Sang Hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 12/453,840

(22) Filed: May 22, 2009

(65) Prior Publication Data

US 2009/0288454 A1 Nov. 26, 2009

(30) Foreign Application Priority Data

May 23, 2008 (KR) ..... 10-2008-0048188

(51) Int. Cl.
*D06F 39/02* (2006.01)

(52) U.S. Cl. ..... 68/17 R; 68/207

(58) Field of Classification Search ..... 68/17 R, 68/207

See application file for complete search history.

(56) References Cited

U.S. PATENT DOCUMENTS

| | | | | |
|---|---|---|---|---|
| 2,941,725 | A * | 6/1960 | Federighi et al. | 239/61 |
| 3,139,890 | A * | 7/1964 | Moran | 134/100.1 |
| 3,826,408 | A | 7/1974 | Berndt et al. | |
| 5,842,599 | A * | 12/1998 | Douma et al. | 222/1 |
| 5,870,906 | A | 2/1999 | Denisar | |
| 2006/0272360 | A1* | 12/2006 | Hsu et al. | 68/19 |
| 2008/0028802 | A1* | 2/2008 | Jordan et al. | 68/12.18 |

FOREIGN PATENT DOCUMENTS

| | | | |
|---|---|---|---|
| DE | 24 24 393 | * | 12/1975 |
| DE | 26 15 469 | * | 10/1977 |
| DE | 3246127 | | 6/1984 |
| EP | 0 268 451 | | 5/1988 |
| EP | 1 884 584 | | 2/2008 |
| EP | 2196574 | | 6/2010 |
| FR | 2352094 | | 12/1977 |
| FR | 2 486 794 | * | 1/1982 |
| GB | 2 214 524 | * | 9/1989 |
| GB | 2 377 927 | * | 1/2003 |
| JP | 61-172591 | * | 8/1986 |
| JP | 64-040483 | | 3/1989 |
| JP | 04-338488 | * | 11/1992 |
| JP | 2003-024261 | * | 1/2003 |
| JP | 2030045 | * | 7/2003 |
| KR | 10-0758363 | | 9/2007 |
| WO | WO 2006/073885 | | 7/2006 |
| WO | WO 2008/016683 | | 2/2008 |

OTHER PUBLICATIONS

European Patent Office 0 611 843 Aug. 1994.*

* cited by examiner

*Primary Examiner* — Frankie L Stinson
(74) *Attorney, Agent, or Firm* — McKenna Long & Aldridge LLP

(57) ABSTRACT

A detergent supply apparatus comprising a storage space adjacent to a washing space in which washing is performed, a detergent bottle seat provided in the storage space and adapted to receive a detergent bottle containing a liquid detergent, a detergent reservoir in fluid communication with the detergent bottle, and a connecting part adapted to fix a portion of the detergent bottle to the detergent reservoir such that the liquid detergent can flow through the connecting part and into the detergent reservoir by gravitational force.

17 Claims, 9 Drawing Sheets

DETERGENT SUPPLY APPARATUS AND WASHING MACHINE

This application claims the benefit of Korean Patent Application No. 10-2008-0048188, filed on May 23, 2008, which is hereby incorporated by reference for all purposes as if fully set forth herein.

The present invention relates to a detergent supply apparatus and a washing machine, and more specifically to a detergent supply apparatus and a washing machine that may automatically supply a liquid detergent.

BACKGROUND

In general, a washing machine is an appliance that cleans laundry by washing, rinsing, and dehydrating the laundry to remove dirt on clothes, bedclothes and the like (hereinafter, referred to as laundry) using water, detergent, and mechanical operation.

The washing machine includes a washing tub that is rotatably arranged in the washing machine and ready to receive water and laundry, and a driving apparatus that rotates the washing tub to wash the laundry. In addition, the washing machine further includes a water supply apparatus that supplies water into the washing tub and a water discharge apparatus that drains the water from the washing tub. A detergent supply apparatus is arranged over a water supply fluid passage of the water supply apparatus to supply a detergent to the inside of the washing tub. The detergent supply apparatus includes a dispenser in fluid communication with the washing tub arranged over the water supply fluid passage and a detergent supply box that can be removed from the dispenser and accommodate various detergents.

In the conventional washing machine the detergent supply box is withdrawn from the dispenser, a powder or liquid-type detergent is supplied in the detergent supply box, and then the detergent supply box is inserted back into the dispenser. At this time, when the water supply apparatus operates, the powder or liquid-type detergent in the detergent supply box is supplied into the inside of the washing tub along with water flowing through the water supply fluid passage of the water supply apparatus.

The conventional washing machines have the disadvantage, however, that the detergent supply box must be repeatedly refilled with detergent whenever a new laundry cycle is run. This is inconvenient and time consuming to the user of the washing machine. Furthermore, the amount of detergent supplied to the detergent supply box is subjectively determined by the user, and therefore, too much or too little may be supplied to the washing machine. If the amount of detergent supplied is too excessive, under consumption of the detergent can result, which may lower washing capacity and increase detergent costs to the user.

SUMMARY

A feature of the present invention is to provide a detergent supply apparatus and a washing machine which may automatically supply an appropriate amount of detergent.

Another feature of the present invention is to provide a detergent supply apparatus and a washing machine which may automatically supply a liquid detergent by readily using a commercially available detergent bottle containing a liquid detergent.

The feature of the present invention is not limited to the above instances, and other objects not referred to may be apparently understood by those skilled in the art from the below descriptions.

A detergent supply apparatus according to an exemplary embodiment of the present invention includes a storage space adjacent to a washing space in which washing is performed; a detergent bottle seat provided at the storage space adapted to receive a detergent bottle containing a liquid detergent; a detergent reservoir in fluid communication with the detergent bottle; and a connecting part adapted to fix a portion of the detergent bottle to the detergent reservoir such that the liquid detergent can flow through the connecting part and into the detergent reservoir by gravitational force.

A washing machine according to an exemplary embodiment of the present invention includes a washing tub adapted to wash laundry; a storage drawer provided under the washing tub; a detergent bottle seat provided in the storage drawer and adapted to receive a detergent bottle containing a liquid detergent; a detergent tube to transport liquid detergent to the washing tub; and a connecting part adapted to receive a portion of the detergent bottle such that the liquid detergent can flow through the connecting part and into the detergent tube.

A method for automatically supplying a liquid detergent to a washing machine according to an exemplary embodiment of the present invention comprising: automatically determining a size of a load in a tub; sensing if a level of liquid in a liquid reservoir is sufficient for washing the load of the determined size; activating a detergent pump to draw a predetermined amount of liquid detergent from the liquid reservoir; and supplying the liquid detergent to the tub to be used during a washing cycle.

Details on other exemplary embodiments of the present invention will be given with reference to the detailed descriptions and accompanying drawings.

ADVANTAGEOUS EFFECTS

The detergent supply apparatus and washing machine according to the present invention has one or more advantageous effects as follows:

First, there is an advantage of automatically supplying as much liquid detergent as necessary upon initiation of a wash cycle.

Second, there is an advantage that may improve user's convenience since the commercially available detergent bottle containing the liquid detergent may readily be implemented.

Third, there is an advantage that the detergent bottle is easily detachable and any detachable detergent bottle may be adapted to be received inside the washing machine.

The effects of the present invention are not limited to the above and other effects not referred to may be apparently understood by those skilled in the art from the accompanying claims.

DETAILED DESCRIPTION

Figure 1:
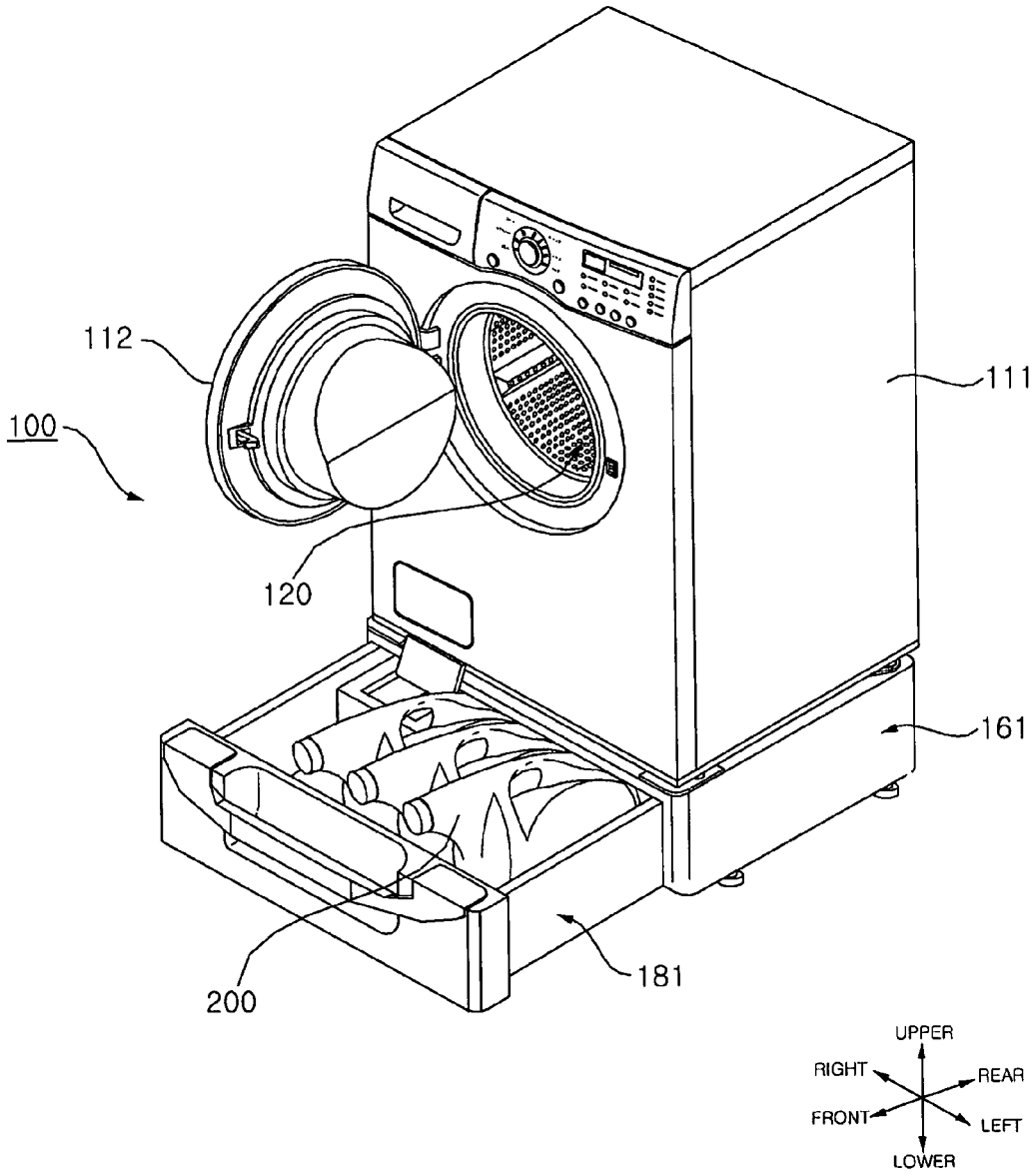
FIG. 1 is a perspective view illustrating a washing machine according to an exemplary embodiment of the present invention.

The advantages and features of the present invention and methods of achieving them will be apparent from the following exemplary embodiments that will be described in more detail with reference to accompanying drawings. However, it should be noted that the present invention is not limited to the following exemplary embodiments, and may be implemented in various forms. Accordingly, the exemplary embodiments are provided only to completely disclose the present invention and let those skilled in the art know the category of the present invention, and rather the scope of the present invention is defined by accompanying claims. Throughout the specification, the same reference numerals refer to the same elements.

Hereinafter, the present invention will be described by its exemplary embodiments with reference to accompanying drawings that illustrate a detergent supply apparatus and a washing machine.

Figure 2:
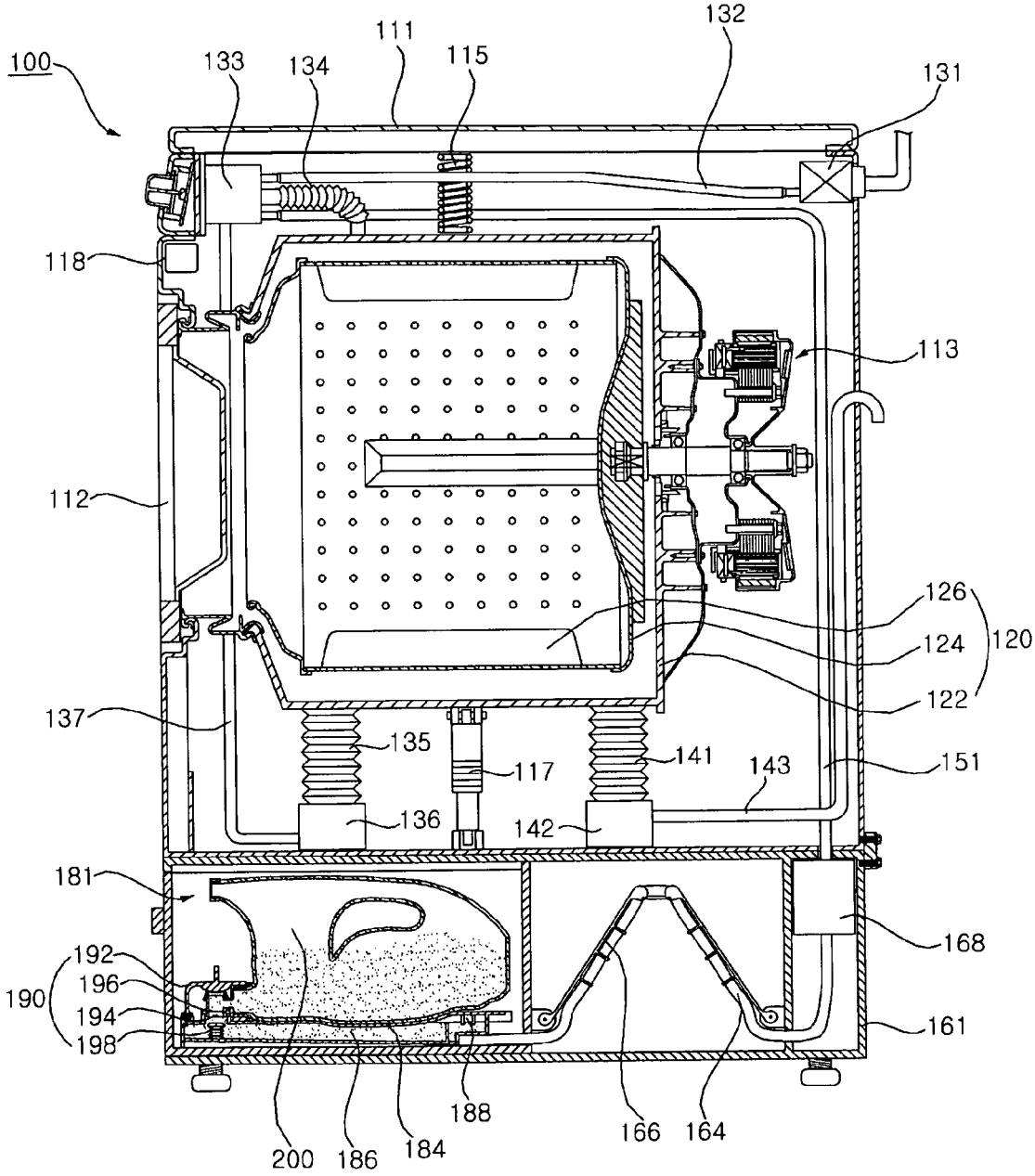
FIG. 2 is a side cross sectional view of the washing machine shown in FIG. 1.
Figure 3:
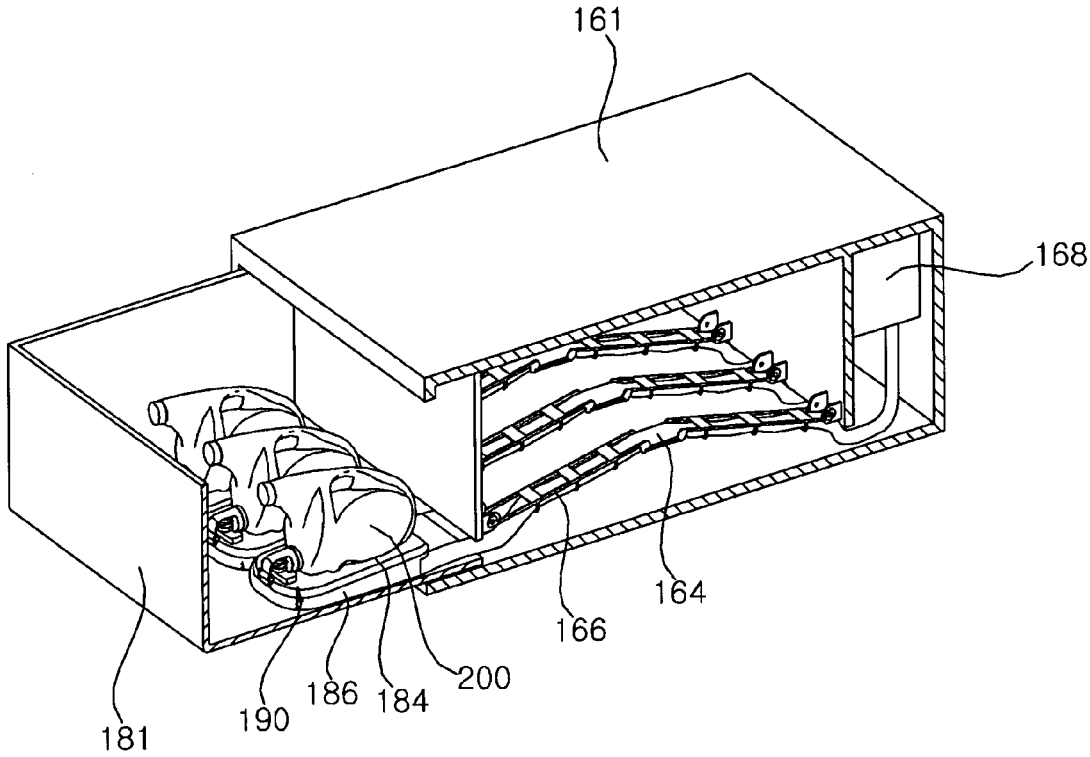
FIG. 3 is a partially exploded perspective view of the washing machine shown in FIG. 1.

FIG. 1 is a perspective view illustrating a washing machine according to an exemplary embodiment of the present invention, FIG. 2 is a side cross sectional view of the washing machine shown in FIG. 1, and FIG. 3 is a partially exploded perspective view of the washing machine shown in FIG. 1.

A washing machine 100 according to an exemplary embodiment of the present invention includes a case 111 forming the external appearance of the washing machine 100, a door 112 opening and closing a side surface of the case 111 so that laundry may be placed and removed to/from the inside of the case 111, a washing tub 120 provided in the inside of the case 111 to wash the laundry, a storage drawer 181 provided under the washing tub 120, and a supporting frame 161 provided under the case 111. A controller may be provided to control the functioning of the washing machine according to predetermined cycles.

The washing tub 120, where laundry is washed with washing water and liquid detergent, is arranged in the inside of the case 111 to be supported a spring 115 and a damper 117 to absorb vibration. Preferably, the washing tub 120 includes a tub 122 for accommodating washing water and liquid detergent therein, and a drum 124. The drum 124 is rotatably arranged inside the tub 122 to accommodate the laundry therein and has a plurality of apertures, through which the washing water and the liquid detergent may pass. A lifter 126 is arranged on an inner surface of the drum 124 to lift and drop the laundry at a predetermined height upon rotation of the drum 124. The drum 124 rotates by a rotation force exerted from a driving part 113 provided in the case 111.

As illustrated in FIG. 2, it is preferable that a washing water supply valve 131, a washing water supply fluid passage 132, and a mixing part 133 are provided on the inside of the case 111. The washing water supply valve 131 may supply washing water from an external water source, and the washing water flows through the washing water supply fluid passage 132 and the washing water supply valve 131 into the mixing part 133. The mixing part 133 mixes the washing water with a liquid detergent, and the mixed water and detergent may flow into the tub 122 via a fluid supply passage 134.

In addition, it is preferable that a circulation tube 135, a circulation pump 136, and a circulation fluid passage 137 are provided in the case 111. The circulation tube 135 provides a passage for the washing water and liquid detergent to exit the tub 122 to be circulated by the circulation pump 136. The circulation fluid passage 137 provides a passage for the washing water and liquid detergent to flow into the mixing part 133.

It is also preferable that a water discharge tube 141, a water discharge pump 142, and a water discharge fluid passage 143 are provided in the case 111. The water discharge tube 141 provides a passage for the used washing water and liquid detergent to exit and be discharged from the tub 122 as it is pumped by the water discharge pump 142. The water discharge fluid passage 143 then provides a passage for the washing water and liquid detergent to be discharged outside the washing machine.

It is understood that the structure and arrangement inside the washing tub 120 and the case 111 described above may be altered by those skilled in the art.

The storage drawer 181 may include a detergent bottle seat 184, on which a detachable detergent bottle 200 containing a liquid detergent is seated, a detergent bottle connecting part 190 connected to the detergent bottle 200, through which a liquid detergent flows, and a detergent reservoir 186 connected to the detergent bottle 200 by the detergent bottle connecting part 190, in which the liquid detergent is stored after passing from the bottle 200 by force of gravity.

Figure 6:
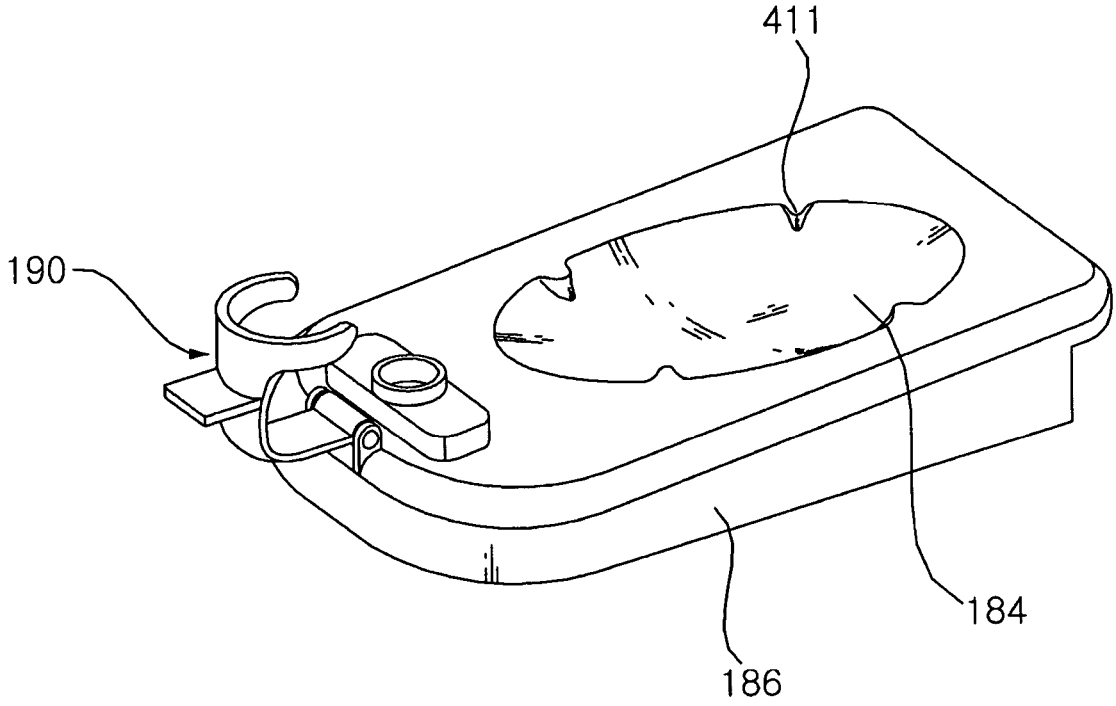
FIG. 6 is a view illustrating a detergent bottle seat included in a washing machine according to another exemplary embodiment of the present invention.
Figure 7:
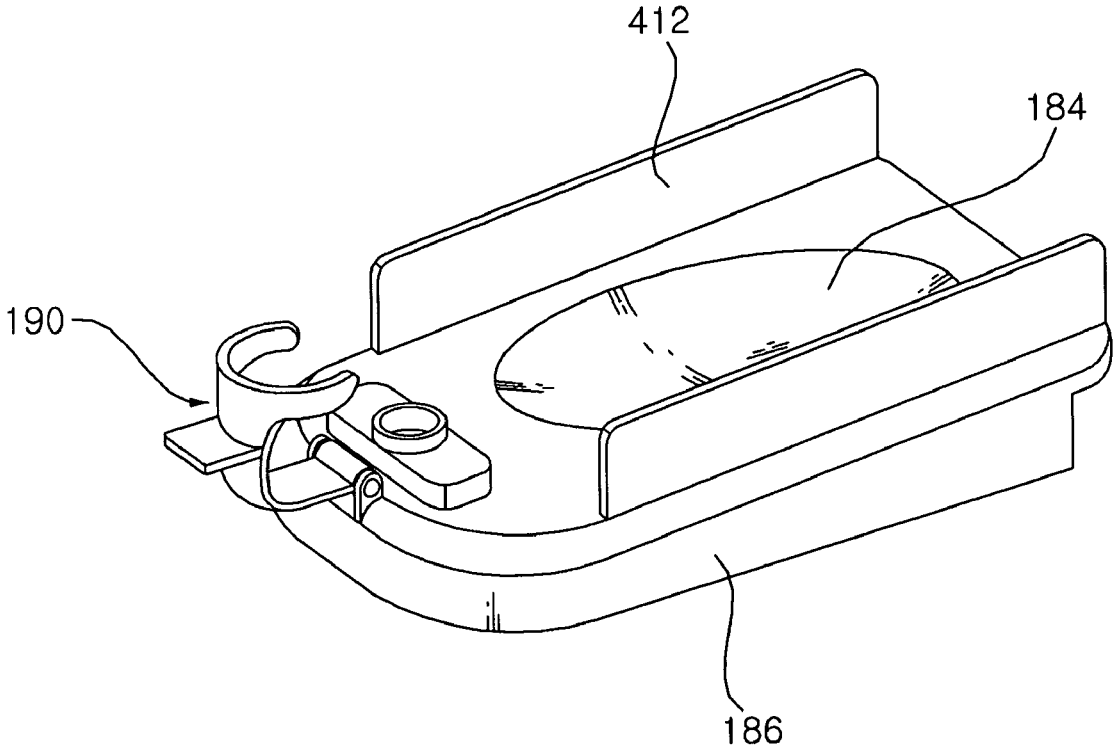
FIG. 7 is a view illustrating a detergent bottle seat included in a washing machine according to still another exemplary embodiment of the present invention.
Figure 8:
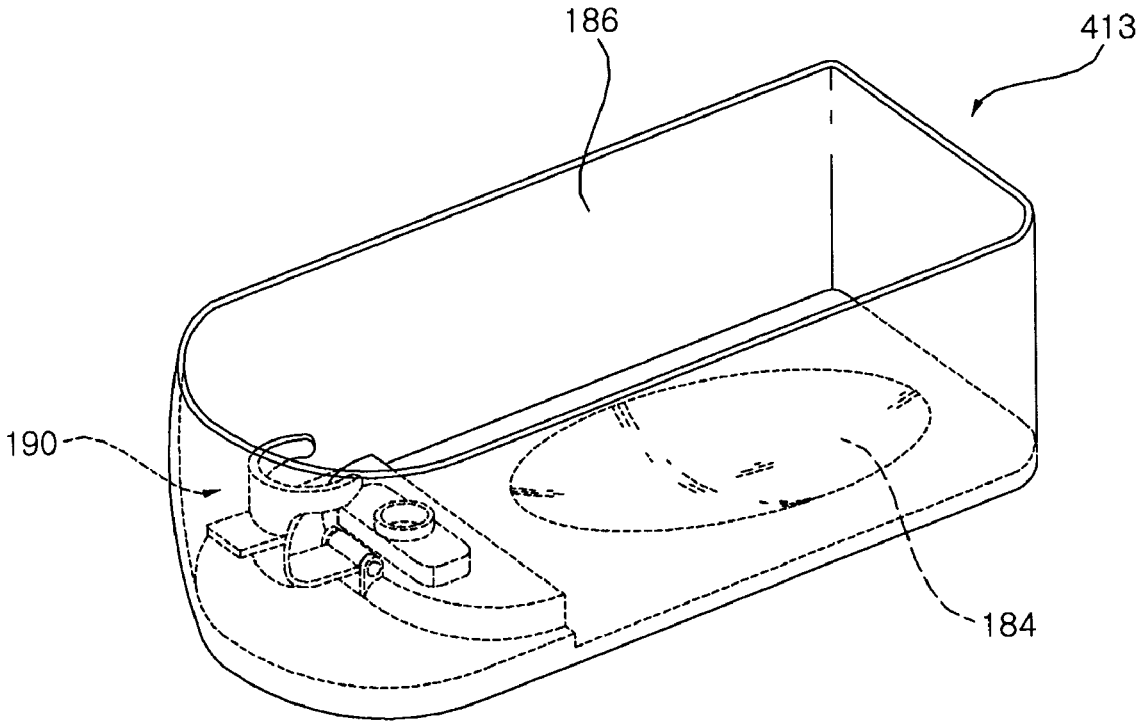
FIG. 8 is a view illustrating the structure of a detergent bottle seat and a detergent storing part included in a washing machine according to yet still another exemplary embodiment of the present invention.

As illustrated in FIG. 3, the detergent bottle seat 184 may be preferably provided in plurality so that a plurality of detergent bottles may be used. In this case, each individual detergent bottle seat 184 may contain one of a plurality of detergents such as a liquid detergent for washing, a liquid detergent for rinsing (fabric softener), and a liquid detergent for bleaching. The detergent bottle seat 184 is preferably formed to fit the shape of a side surface of the detergent bottle 200, and may be formed of an elastic member which may be deformable depending on the shape of the detergent bottle 200. Various examples of detergent bottle seats 184 are illustrated in FIGS. 6 to 8.

The detergent bottle 200, having liquid detergent therein, is detachably usable with the washing machine. Any commercially available detergent bottle containing a liquid detergent may be readily utilized or adapted for use as the detergent bottle 200. The detergent bottle connecting part 190 connects the detergent bottle 200 with the detergent reservoir 186. The detergent bottle connecting part 190 is preferably provided in plurality so that a plurality of detergent bottles may be used. Three detergent bottle connecting parts 190 are provided in the exemplary embodiment of the present invention, however, it is envisioned that any number of detergent bottle connecting parts 190 may be incorporated. The detergent bottle connecting part 190 includes a detergent bottle fixing part 192 that fixes the detergent bottle 200 to the detergent reservoir 186, a detergent inlet 194 into which the liquid detergent is entered, a sealing part 196 that prevents the leakage of the liquid detergent entering into the detergent inlet 194, and a check valve 198 that prevents the back-flow of the liquid detergent stored in the detergent reservoir 186. The check valve 198 may be omitted depending on the placement of the reservoir 186. For example, if the reservoir 186 is positioned above the mixing part 133, a check valve 198 may not be required.

A detailed description of the detergent bottle fixing part 192 will be given later with reference to FIGS. 4 and 5.

The detergent inlet 194 enables the detergent bottle 200 to fluidly communicate with the detergent reservoir 186 so that the liquid detergent exiting from the detergent bottle 200 may enter and be stored in the detergent reservoir 186. The detergent inlet 194 may be formed so that the liquid detergent contained in the detergent bottle 200 may flow into the detergent reservoir 186 due to its weight and the force of gravity. The detergent inlet 194 preferably includes the sealing member 196 that prevents liquid detergent flowing from the detergent bottle 200 from escaping from the detergent inlet 194. In addition, in the embodiments illustrated herein, the detergent inlet 194 is preferably closed by the check valve 198 when the detergent bottle 200 is removed from the detergent inlet 194.

The detergent reservoir 186 stores the liquid detergent received from the detergent bottle 200 and is preferably provided in plurality so that a plurality of detergent bottles may be used. Three detergent reservoirs 186 are provided in the exemplary embodiment of the present invention, but any number is envisioned and within the scope of the invention. The detergent reservoir 186 is preferably provided in the inside of the storage drawer 181. The detergent reservoir 186 preferably includes a sensor 188 that senses a level of liquid detergent stored in the reservoir 186. The sensor 188 is used to sense when the level of the liquid detergent stored in the detergent reservoir 186 is insufficient for washing. The result of the detection may be displayed externally to communicate the presence or lack of presence of detergent to a user. The output of the sensor 188 may additionally or alternatively be coupled to controller 118 for data processing.

As illustrated in FIGS. 2 and 3, a detergent pump 168, a detergent reservoir 186, a detergent tube 164, and a detergent tube support 166 are provided in the supporting frame 161. The detergent pump 168 acts to supply the liquid detergent stored in the detergent reservoir 186 to the washing tub 120. The detergent tube 164 is movably supported by detergent tube support 166, and fluidly connects the detergent reservoir 186 with the detergent pump 168.

The detergent pump 168 pumps the liquid detergent stored in the detergent reservoir 186 through a detergent supply passage 151 to the mixing part 133. The detergent pump 168 is preferably implemented as a tube pump that extrudes fluid detergent from the detergent tube 164 in increments. When the detergent tube 164 is provided in plurality corresponding to the plurality of detergent reservoirs 186, the detergent pump 168 may be provided in plurality. However, the present invention may be also configured so that a single detergent tube 164 and a single detergent pump 168 are provided for the plurality of detergent reservoirs 186.

The detergent pump 168 is preferably operated so that the liquid detergent may be automatically supplied in an amount that is appropriate depending on the amount of laundry and the concentration of the fluid.

The detergent tube support 166 flexibly connects the storage drawer 181 with the supporting frame 161 and the detergent tube support 166 preferably supports the detergent tube 164. The detergent tube support 166 preferably has joints that allow the detergent tube support 166 to extend and retract when the storage drawer 181 is opened and closed, respectively. The detergent tube support 166 may be omitted, however, if the detergent tube 164 is implemented to be otherwise extendable. This extendibility may be implemented variously by those skilled in the art.

Figure 4:
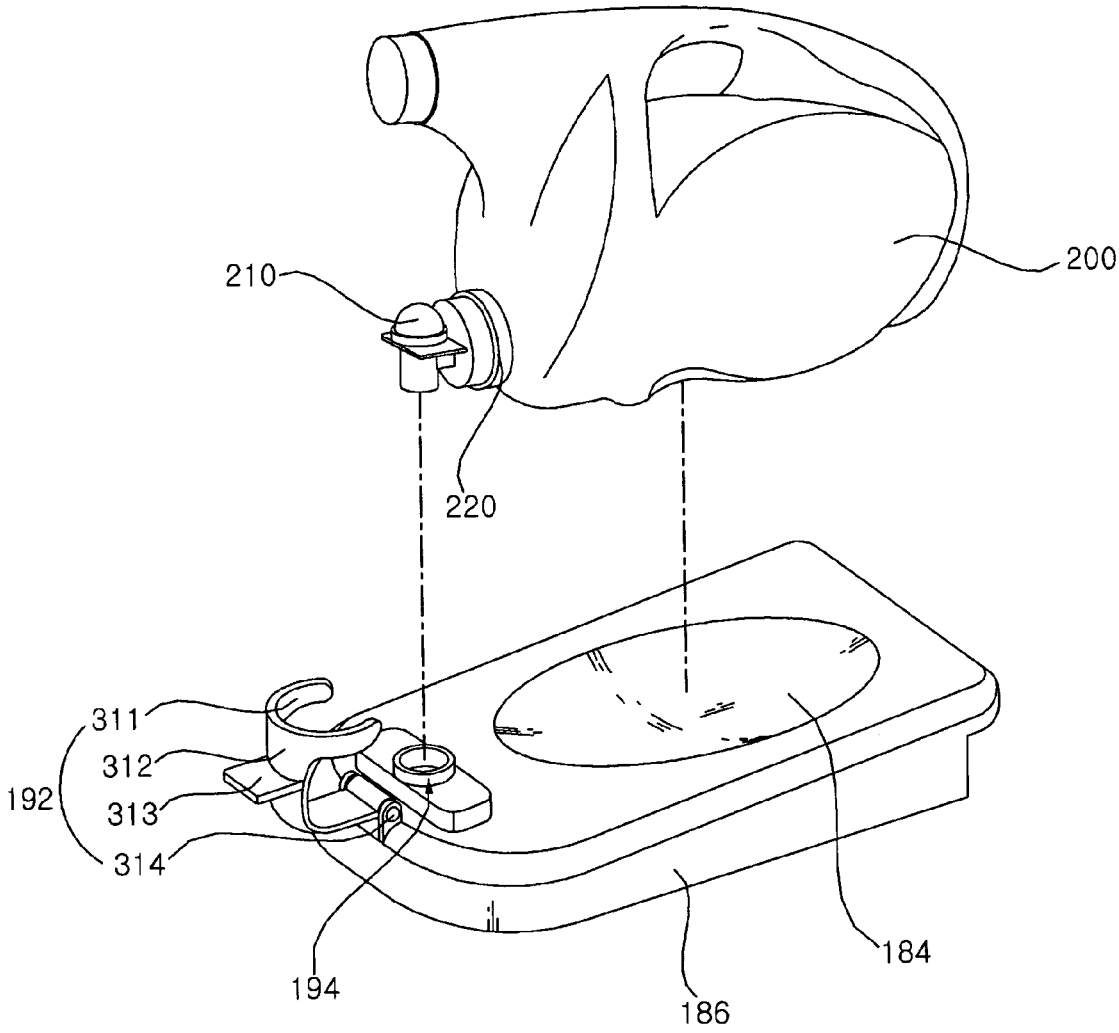
FIGS. 4 and 5 are perspective views illustrating a detergent bottle fixing part included in a washing machine according to an exemplary embodiment of the present invention.
Figure 5:
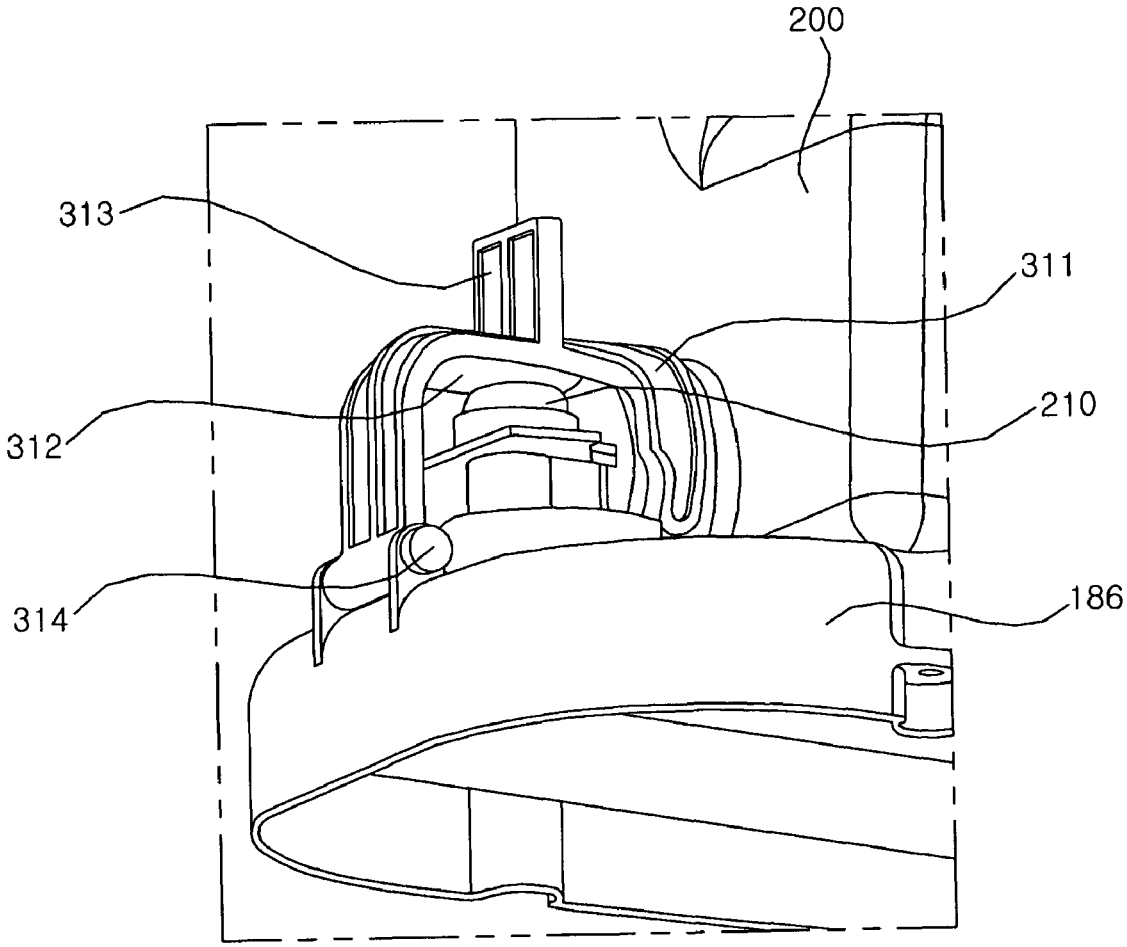

FIGS. 4 and 5 are perspective views of a detergent bottle fixing part 192 included in the washing machine according to an exemplary embodiment of the present invention.

The detergent bottle fixing part 192 may include an outlet fixing part 311 that fixes a detergent outlet 220 of the detergent bottle 200 to the detergent reservoir 186, a button pressing part 312 that presses a detergent outlet button 210 of the detergent bottle 200 to permit liquid detergent to flow from the detergent bottle 200, a handle part 313 that enables a user to rotate the detergent bottle fixing part 192 by his/her hand, and a hinge part 314 that connects the detergent bottle fixing part 192 with the detergent reservoir 186 so that the detergent bottle fixing part 192 may rotate or pivot.

The outlet fixing part 311 fixes the detergent outlet 220 of the detergent bottle 200 and may be implemented variously depending on the shape of the detergent outlet 220. In the exemplary embodiment of the present invention, the outlet fixing part 311 is implemented to be shaped as a partially open circle so that the circular shaped detergent outlet 220 may easily be inserted in the outlet fixing part 311.

The button pressing part 312 presses the detergent outlet button 210 upon setting the detergent bottle 200 in place and the detergent bottle fixing part 192 is rotated down against outlet button 210, and may be implemented variously depending on the location and shape of the detergent outlet button 210. In the exemplary embodiment of FIG. 5, the button pressing part 312 is implemented to be shaped as a plate-like structure extended from the outlet fixing part 311. In the embodiments shown, depressing the detergent outlet button 210 opens a valve of the detergent bottle 200. However, it will be understood that any structure adapted to open a valve of the detergent bottle 200, regardless of the shape or operation of the valve, is within the scope of the invention.

The handle part 313 enables the user to rotate the detergent bottle fixing part 192. The handle part 313 is implemented to be shaped as a plate that is formed perpendicular to the outlet fixing part 311 in the exemplary embodiment of the present invention, but is envisioned to be any size and shape that may accommodate the user. The hinge part 314 connects the detergent bottle fixing part 192 with the detergent reservoir 186 so that the detergent bottle fixing part 192 may rotate.

It is understood that the structure of the aforementioned detergent bottle fixing part 192 may be implemented variously by those skilled in the art depending on the shape of the detergent bottle 200.

FIG. 6 is a view illustrating a detergent reservoir 186 included in a washing machine according to another exemplary embodiment of the present invention.

The detergent bottle seat 184 includes a detergent bottle fixing protrusion 411 that may fix or position the detergent bottle 200 in place. The detergent bottle fixing protrusion 411 may be implemented variously depending on the shape of the detergent bottle 200 so as to be capable of fixing the detergent bottle 200 on the detergent bottle seat 184.

FIG. 7 is a view illustrating a detergent bottle seat 184 included in a washing machine according to still another exemplary embodiment of the present invention.

The detergent bottle seat 184 includes a detergent bottle support 412 that is adapted to prevent lateral movement or axial rotation of the detergent bottle 200. The detergent bottle support 412 may be implemented variously depending on the shape of the detergent bottle 200.

FIG. 8 is a view illustrating the structure of a detergent bottle seat 184 and a detergent reservoir 413 included in a washing machine according to yet still another exemplary embodiment of the present invention.

The detergent reservoir 413 is opened at its top. The detergent bottle seat 184 and the detergent bottle connecting part 190 are provided at the lower part in the detergent reservoir 413. That is, it is implemented such that the detergent bottle 200 itself may be placed in the inside of the detergent reservoir 413 or the liquid detergent may be poured directly in the detergent reservoir 413 upon use.

Figure 9:
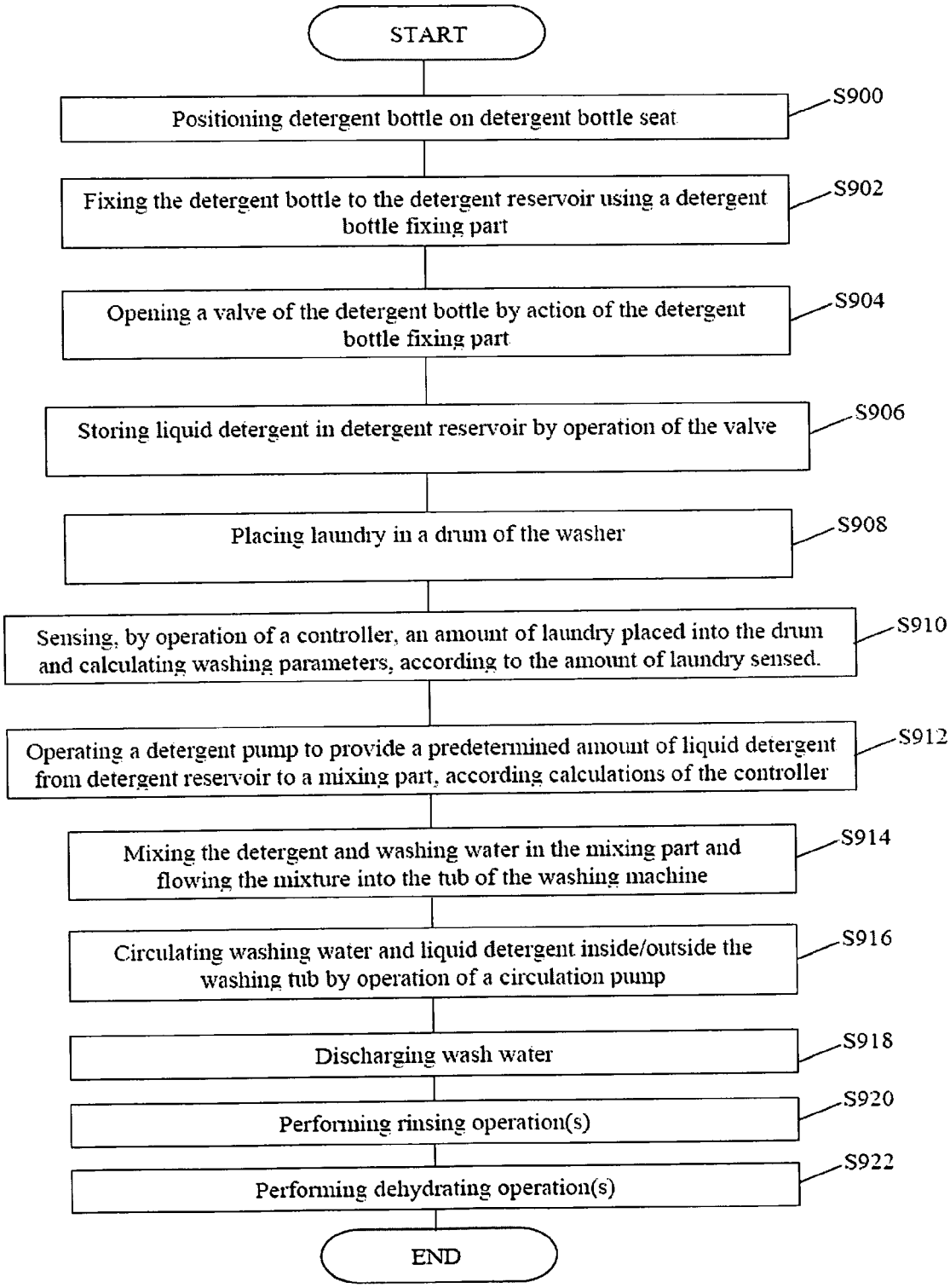
FIG. 9 is a flow chart illustrating a method according to an exemplary embodiment of the present invention.

An operation of the washing machine according to the present invention, configured above, will now be described with reference to FIG. 9. FIG. 9 is a flow chart illustrating a method according to an exemplary embodiment of the present invention.

The storage drawer 181 is withdrawn so that the detergent bottle 200 may be positioned on the detergent bottle seat 184 (S900), and the detergent bottle fixing part 192 of the detergent bottle connecting part 190 may be rotated into place to fix the detergent bottle 200 to the detergent reservoir 186. (S902) The detergent bottle fixing part 192 also opens a valve of the detergent bottle 200 to permit liquid to flow from the detergent bottle 200 into the reservoir 186. (S904) Once the detergent bottle 200 is in fluid communication with the detergent reservoir 186, the liquid detergent contained in the detergent bottle 200 is dispensed through the detergent inlet 194 and stored in the detergent reservoir 186. (S906)

As should be understood, before operation of the washing machine, the door 112 is opened so that laundry may be placed in the tub 122 of the washing tub 120. (S908) When the door 112 is closed and sealed the controller 118 may sense the amount of laundry placed in the tub 122 and set an appropriate water level, a predetermined amount of detergent, washing time, and the like, according to the amount of laundry sensed. (S910) Of course, a user may set these parameters manually.

The washing water supply valve 131 opens so that a predetermined amount of washing water may be supplied from an external water source. In addition, the detergent pump 168 operates so that the predetermined amount of liquid detergent stored in the detergent reservoir 186 may be supplied to the mixing part 133 in accordance with the settings determined by the controller 118 or manually entered by the user. (S912) When plural detergent reservoirs 186 are provided, various liquid detergents for washing may be supplied to the mixing part 133.

When the detergent pump 168 operates, the liquid detergent stored in the detergent reservoir 186 flows into the mixing part 133 via the detergent tube 164 and the detergent supply fluid passage 151. The washing water and the liquid detergent are mixed in the mixing part 133 and then flow into the tub 122 of the washing tub 120 through the water supply fluid passage 134. (S914)

When supplying of the washing water and the liquid detergent to tub 122 is complete, the driving part 113 rotates the drum 124 for a predetermined time. At this time, the washing water and the liquid detergent are circulated inside/outside the washing tub 120 by the circulation pump 136. (S916)

When the above-mentioned process is complete, the driving part 113 stops and the water discharge pump 142 operates so that the washing water and the liquid detergent used for washing are discharged to the outside. (S918) Then, the washing water supply valve 131 may be opened so that the washing water is re-supplied from the external water source and the detergent pump 168 operates so that a predetermined amount of liquid detergent for rinsing is supplied to the mixing part 133.

A rinsing process is then performed as the washing water and the liquid detergent, if any, are mixed in the mixing part 133 and flow into the tub 122 of the washing tub 120 through the water supply fluid passage 134, and the driving part 113 operates to rotate the drum 124 for a predetermined time. (S920)

When the above-mentioned rinsing process is complete, the driving part 113 stops and the water discharge pump 142 operates so that the washing water and the liquid detergent are discharged to the outside, and then a dehydrating process and a drying process may be performed according to the setup. (S922)

The sensor 188 monitors the level of the detergent in the reservoir 186. The sensor 188 senses when the amount of the liquid detergent stored in the detergent reservoir 186 is insufficient for washing. Upon this occurrence, a message or indicator light may be displayed to alert the user of a need for additional liquid detergent. The output of the sensor 188 may additionally or alternatively be coupled to the controller 118, for data processing of the sensor signal.

Even though the detergent supply apparatus and the washing machine according to the present invention have been described with reference to accompanying drawings, the present invention is not limited to the above exemplary embodiments, and may be modified or varied by those skilled in the art without departing from the spirit and scope of the present invention.

Even though it has been described that the items to be washed are laundry items and the washing space is the washing tub, the present invention is not limited thereto. For example, the detergent supply apparatus may be applied to other washing apparatuses such as a dishwasher having different items to be washed and a different washing space from that of the washing machine.

Furthermore, the present invention is not limited to the drum-type washing machines and may be also applied to other types of washing machines such as a pulsator type or agitator type washing machine, including washing machines in which detergent is delivered directly into the tub 122 without any use of a mixing part 133.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A detergent supply apparatus comprising:

a storage space adjacent to a washing space in which washing is performed;

a detergent bottle seat provided in the storage space and adapted to receive a detergent bottle containing a liquid detergent;

a detergent reservoir in fluid communication with the detergent bottle; and a connecting part adapted to fix a portion of the detergent bottle to the detergent reservoir such that the liquid detergent can flow through the connecting part and into the detergent reservoir by gravitational force, wherein the connecting part includes a fixing part that holds a detergent outlet of the detergent bottle in a fixed relation to the reservoir, wherein the fixing part comprises, an outlet fixing part fixing the detergent outlet of the detergent bottle to the detergent reservoir;

a button pressing part pressing a detergent outlet button of the detergent bottle to permit liquid detergent to flow from the detergent bottle; and a hinge part connecting the fixing part with the detergent reservoir rotatably.

2. The detergent supply apparatus of claim 1, the detergent bottle seat comprising an upper surface and a lower surface, wherein the upper surface is adapted to receive the detergent bottle; and wherein the detergent reservoir extends along at least a portion of the lower surface.

3. The detergent supply apparatus of claim 1, wherein the detergent bottle seat extends between at least a length of each of the detergent bottle and the detergent reservoir.

4. The detergent supply apparatus of claim 1, wherein the detergent bottle seat is formed to fit a contour of a surface of the detergent bottle.

5. The detergent supply apparatus of claim 1, wherein the detergent bottle seat includes a detergent bottle fixing protrusion adapted to fix the detergent bottle to the detergent bottle seat.

6. The detergent supply apparatus of claim 1, wherein the detergent bottle seat is formed of an elastic member that is adapted to conform to a contour of a surface of the detergent bottle.

7. The detergent supply apparatus of claim 1, wherein the detergent bottle seat includes a detergent bottle support adapted to support the detergent bottle, and prevent lateral movement or axial rotation.

8. The detergent supply apparatus of claim 1, wherein the fixing part opens a valve of the detergent bottle so that the liquid detergent is dispensed from the detergent bottle.

9. The detergent supply apparatus of claim 1, wherein the connecting part includes a detergent inlet adapted to receive the liquid detergent flowing from the detergent bottle, and a sealing member that prevents liquid detergent flowing from the detergent bottle into the detergent inlet from escaping from the detergent inlet.

10. The detergent supply apparatus of claim 1, wherein the connecting part includes:

a detergent inlet adapted to receive the liquid detergent flowing from the detergent bottle into the detergent reservoir; and a check valve that prevents a back-flow of the liquid detergent from the detergent reservoir.

11. The detergent supply apparatus of claim 1, wherein the detergent bottle seat and the connecting part are arranged on the inside of the storage space, and wherein the detergent bottle is seated on the detergent bottle seat inside the storage space.

12. The washing machine of claim 11, wherein the detergent reservoir includes a sensor that senses a level of liquid detergent stored in the reservoir.

13. The detergent supply apparatus of claim 1, wherein the detergent reservoir includes a sensor that senses a level of liquid detergent stored in the reservoir.

14. A washing machine comprising:

a washing tub adapted to wash laundry;

a storage drawer provided under the washing tub;

a detergent bottle seat provided in the storage drawer and adapted to receive a detergent bottle containing a liquid detergent;

a detergent tube to transport liquid detergent to the washing tub; and a connecting part adapted to receive a portion of the detergent bottle such that the liquid detergent can flow through the connecting part and into the detergent tube, wherein the connecting part includes a fixing part that holds a detergent outlet of the detergent bottle in a fixed relation to the reservoir, wherein the fixing part comprises, an outlet fixing part fixing the detergent outlet of the detergent bottle to the detergent reservoir;

a button pressing part pressing a detergent outlet button of the detergent bottle to permit liquid detergent to flow from the detergent bottle; and a hinge part connecting the fixing part with the detergent reservoir rotatably.

15. The washing machine of claim 14, wherein the detergent bottle seat is formed to fit a contour of a surface of the detergent bottle.

16. The washing machine of claim 14, wherein the detergent bottle seat includes a detergent bottle fixing protrusion adapted to fix the detergent bottle to the detergent bottle seat.

17. The washing machine of claim 14, wherein the detergent bottle seat and the connecting part are arranged inside of the storage drawer, wherein the detergent bottle is seated on the detergent bottle seat inside the storage drawer.

* * * * *